US010174924B1

(12) United States Patent
Mart

(10) Patent No.: US 10,174,924 B1
(45) Date of Patent: Jan. 8, 2019

(54) HEAT SINK FOR AN LED LIGHT FIXTURE

(71) Applicant: Gary K. Mart, Bonita Springs, FL (US)

(72) Inventor: Gary K. Mart, Bonita Springs, FL (US)

( * ) Notice: Subject to any disclaimer, the term of this patent is extended or adjusted under 35 U.S.C. 154(b) by 707 days.

(21) Appl. No.: 13/729,859

(22) Filed: Dec. 28, 2012

Related U.S. Application Data

(60) Provisional application No. 61/582,101, filed on Dec. 30, 2011.

(51) Int. Cl.

| | |
|---|---|
| ***F21V 29/00*** | (2015.01) |
| ***F21V 29/57*** | (2015.01) |
| ***F21V 29/60*** | (2015.01) |
| ***F21V 29/67*** | (2015.01) |
| ***F21V 29/70*** | (2015.01) |
| ***F21V 29/78*** | (2015.01) |

(52) U.S. Cl.
CPC ..... *F21V 29/2212* (2013.01); *F21V 29/57* (2015.01); *F21V 29/67* (2015.01); *F21V 29/70* (2015.01); *F21V 29/60* (2015.01); *F21V 29/78* (2015.01)

(58) Field of Classification Search
USPC ..... 362/294, 373; 361/697; 165/121, 185
See application file for complete search history.

(56) References Cited

U.S. PATENT DOCUMENTS

| | | | | |
|---|---|---|---|---|
| 5,661,638 | A * | 8/1997 | Mira | 361/697 |
| 5,785,116 | A * | 7/1998 | Wagner | 165/80.3 |
| 6,196,300 | B1 * | 3/2001 | Checchetti | 165/80.3 |
| 6,657,862 | B2 * | 12/2003 | Crocker et al. | 361/697 |
| 7,063,130 | B2 * | 6/2006 | Huang | 165/121 |
| 7,623,348 | B2 * | 11/2009 | Otsuki et al. | 361/697 |
| 2011/0114296 | A1 * | 5/2011 | Horng et al. | 165/104.34 |
| 2011/0146966 | A1 * | 6/2011 | Scherrer | 165/287 |
| 2012/0081904 | A1 * | 4/2012 | Horng | 362/294 |
| 2012/0104951 | A1 * | 5/2012 | Taubert et al. | 315/117 |
| 2012/0223640 | A1 * | 9/2012 | Koplow | 315/50 |

FOREIGN PATENT DOCUMENTS

WO WO 2009149460 A1 * 12/2009

* cited by examiner

*Primary Examiner* — Alexander K Garlen
(74) *Attorney, Agent, or Firm* — Patents on Demand, P.A.; Brian K. Buchheit

(57) ABSTRACT

A heat sink arrangement can be comprised of a substantially planar base and fins extending upwards from the planar base. The planar base can be shaped in accordance with a light-emitting diode (LED) light fixture. An improved heat sink that the planar base is a component of can be capable of fitting within the LED light fixture. The space between the fins can form air pathways. Each fin can be substantially arced in shape, originating from a central region of the planar base and ending at an outside edge of the planar base.

7 Claims, 9 Drawing Sheets

HEAT SINK FOR AN LED LIGHT FIXTURE

CROSS-REFERENCE TO RELATED APPLICATION

This application claims the benefit of Provisional Application Ser. No. 61/582,101 entitled "CONTROL AND LIGHTING SYSTEM", filed Dec. 30, 2011, and U.S. patent application Ser. No. 12/996,221 entitled "LED LIGHT BULB", both of which are herein incorporated by reference in their entirety.

BACKGROUND

The present invention relates to the field of lighting and, more particularly, to an improved heat sink for a light-emitting diode (LED) light fixture.

LED light bulbs have become an increasingly popular replacement to traditional incandescent and fluorescent lights. For high-powered applications, such as industrial lighting or streetlights, the LED light fixture typically includes a means for dissipating heat away from the LEDs as LED performance is temperature-dependent. Thermal regulation is further compounded when the LED light is used in an environment that often experiences high temperatures like a factory.

In an LED light fixture, the LED lights and heat sink are enclosed in a housing that is connected to the lighting system. The air trapped within the housing acts as an insulator, retaining heat; hence, a heat sink is required for heat dissipation. A conventional heat sink for an LED light is typically a grooved or finned component that provides substantial surface area to absorb the heat from the trapped air like those generally used in computers or other electronics.

Further, the more heat that needs to be dissipated, the larger the heat sink must be in order to provide ample surface area. Increasing the size of the heat sink also increases the overall weight and/or size of the fixture. This is particularly problematic when retrofitting an existing non-LED lighting system with high-powered LED lights. The high-powered LED light fixture must be able to fit into the space of fixture it is replacing and stay in the desired position.

BRIEF SUMMARY

One aspect of the present invention can include a heat sink arrangement comprised of a substantially planar base and fins extending upwards from the planar base. The planar base can be shaped in accordance with a light-emitting diode (LED) light fixture. An improved heat sink that the planar base is a component of can be capable of fitting within the LED light fixture. The space between the fins can form air pathways. Each fin can be substantially arced in shape, originating from a central region of the planar base and ending at an outside edge of the planar base.

Another aspect of the present invention can include an improved heat sink for an LED light fixture. The improved heat sink can include an active cooling component and a passive cooling component. The active cooling component can be configured to propel air in a desired direction. The passive cooling component can be configured to organize the air propelled by the active cooling component to evenly dissipate heat within the enclosed space of the LED light fixture.

Yet another aspect of the present invention can include an LED light fixture arrangement that comprises an LED light fixture, an air gap, and an improved heat sink. The LED light fixture can be installed in an environment where the LED light fixture is subjected to external heat that raises an internal temperature of the LED light fixture above a predefined threshold. The predefined threshold can represent a maximum temperature above which, prolonged exposure adversely affects operating performance and longevity of LED circuitry within the LED light fixture. The air gap can exist between a housing of the LED light fixture and its internal components. The air gap can function as a thermal insulator to minimize an amount of the external heat from the environment that directly affects the LED circuitry. The improved heat sink can be installed within the LED light fixture and can be configured to circulate air within the air gap to maintain the internal temperature of the LED light fixture at or below the predefined threshold.

DETAILED DESCRIPTION

The present invention discloses an improved heat sink for an LED light fixture that more effectively dissipates heat generated by the LEDs as well as the external environment. The improved heat sink can be comprised of an active cooling component that circulates air trapped within the LED light fixture and a passive cooling component that organizes the circulating air. This design allows for the improved heat sink to be lighter and more compact than conventional heat sinks used in LED light fixtures.

As will be appreciated by one skilled in the art, aspects of the present invention may be embodied as a system, method or. Accordingly, aspects of the present invention may take the form of an entirely hardware embodiment or an embodiment combining software (including firmware, resident software, micro-code, etc.) and hardware aspects that may all generally be referred to herein as a "circuit," "module" or "system". Aspects of the present invention are described below with reference to flowchart illustrations and/or block diagrams of methods and/or apparatus (systems) according to embodiments of the invention.

Figure 1:
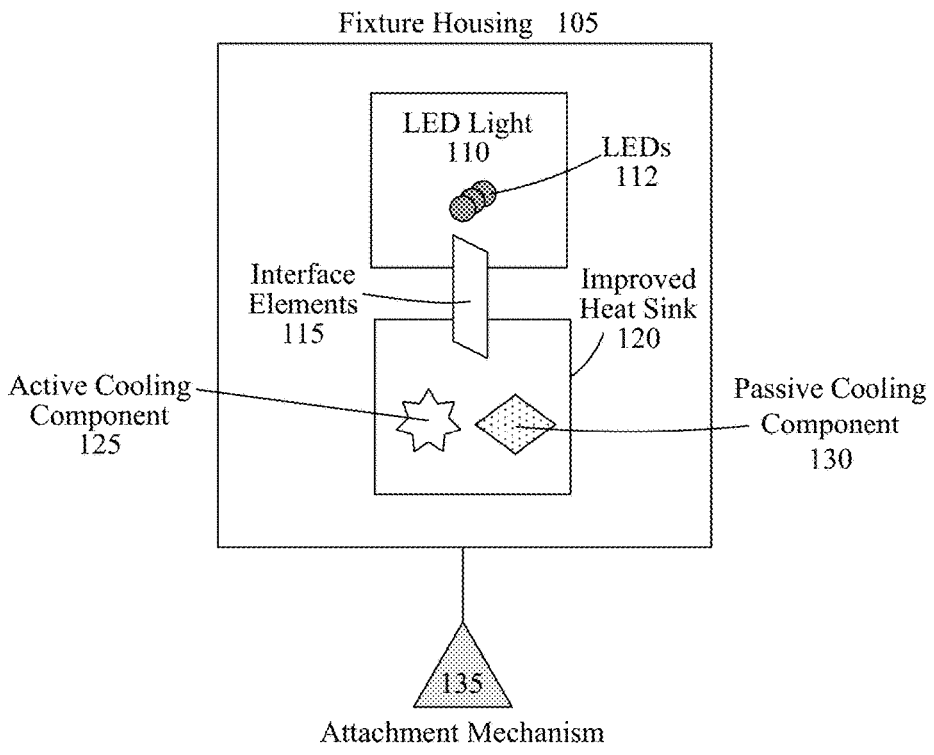
FIG. 1 is a block diagram illustrating a light-emitting diode (LED) light fixture that utilizes an improved heat sink in accordance with embodiments of the inventive arrangements disclosed herein.

FIG. 1 is a block diagram illustrating a light-emitting diode (LED) light fixture 100 that utilizes an improved heat sink 120 in accordance with embodiments of the inventive arrangements disclosed herein. The LED light fixture 100 can be designed for high-power applications, indoor and/or outdoor, where luminance is desired at distances of 100 ft. or more. Example applications of the LED light fixture 100 can include, but are not limited to, streetlights, industrial (e.g., warehouse, factories, etc.) lighting systems, office lighting systems, sports stadiums, parking lots/garages, and the like.

The LED light fixture 100 can be comprised of a fixture housing 105 that encloses one or more LED lights 110 and an improved heat sink 120. The fixture housing 105 can be made from a suitable material for the specific application of the LED light fixture 100. The fixture housing 105 can be coupled with an attachment mechanism 135 for affixing the LED light fixture 100 into the lighting system. The attachment mechanism 135 can represent the mechanical components required to attach the LED light fixture 100 to a desired physical location or mounting surface and can include elements that retrofit the LED light fixture 100 into an existing, non-LED lighting system.

The LED light 110 can represent the lamp or light-producing component of the LED light fixture 100. LED light 110 can include multiple LEDs 112 that are arranged in a variety of configurations, such as the cluster arrangements presented in U.S. Patent Application GTL12001.

The LED light 110 can be coupled with the improved heat sink 120 using one or more interface elements 125. The interface elements 125 can include electrical, mechanical, and/or chemical means of connecting the LED light 110 and improved heat sink 120.

The improved heat sink 120 can be used to dissipate excess heat generated by the LEDs 112 as well as counteract heat from the external environment. This can be of particular importance due to the temperature-sensitivity of the LEDs 112 with respect to performance as well as the high-power nature of the application (i.e., more power tends to equal more heat).

The improved heat sink 120 can include an active cooling component 125 and a passive cooling component 130. The active cooling component 125 can be an electric fan that is powered by the same power source (not shown) that runs the LED light fixture 100. The active cooling component 125 can be designed to operate within the restrictions of the LED light fixture 100 (e.g., size, power consumption, speed, etc.) without disturbing operation of the LED light 110.

The passive cooling component 130 can represent a shaped element that organizes the air flow generated by the active cooling component 125. That is, the passive cooling component 130 can direct how the trapped air circulates within the LED light fixture 100 as driven by the active cooling component 125. By organizing the flow of air inside the LED light fixture 100, the heat from the improved heat sink 120 can be more efficiently and evenly transferred to the fixture housing 105, keeping the interior temperature of the LED light fixture 100 constant.

The heat sink typically used in a conventional LED light fixture can be considered a passive cooling component, though heat dissipation is provided via a different mechanism. A conventional heat sink can be designed to dissipate heat by providing a considerable amount of surface area that draws in the heat from the air. Therefore, the more heat that needs to be dissipated, the larger the heat sink can be made, which also increases the size and weight of the LED light fixture 100.

Since the passive cooling component 130 of the improved heat sink 120 does not need to provide surface area for heat transfer, the passive cooling component 130 can be considerably smaller than its traditional counterpart and need not be made of metal; heat conduction of the passive cooling component's 130 material need not be a limiting factor.

Thus, the improved heat sink 120 can be, overall, smaller and lighter than conventional heat sinks used for LED light fixtures 100, allowing for more design flexibility and application of the LED light fixture 100.

It should also be noted that the trapped air can also act as an insulator when the active cooling component 125 is deactivated. That is, the trapped air can insulate the LEDs 112 and other temperature-sensitive components from external or environmental heat sources, such as the sun. This can further improve the operational lifetime of the LEDs 112.

Figure 2:
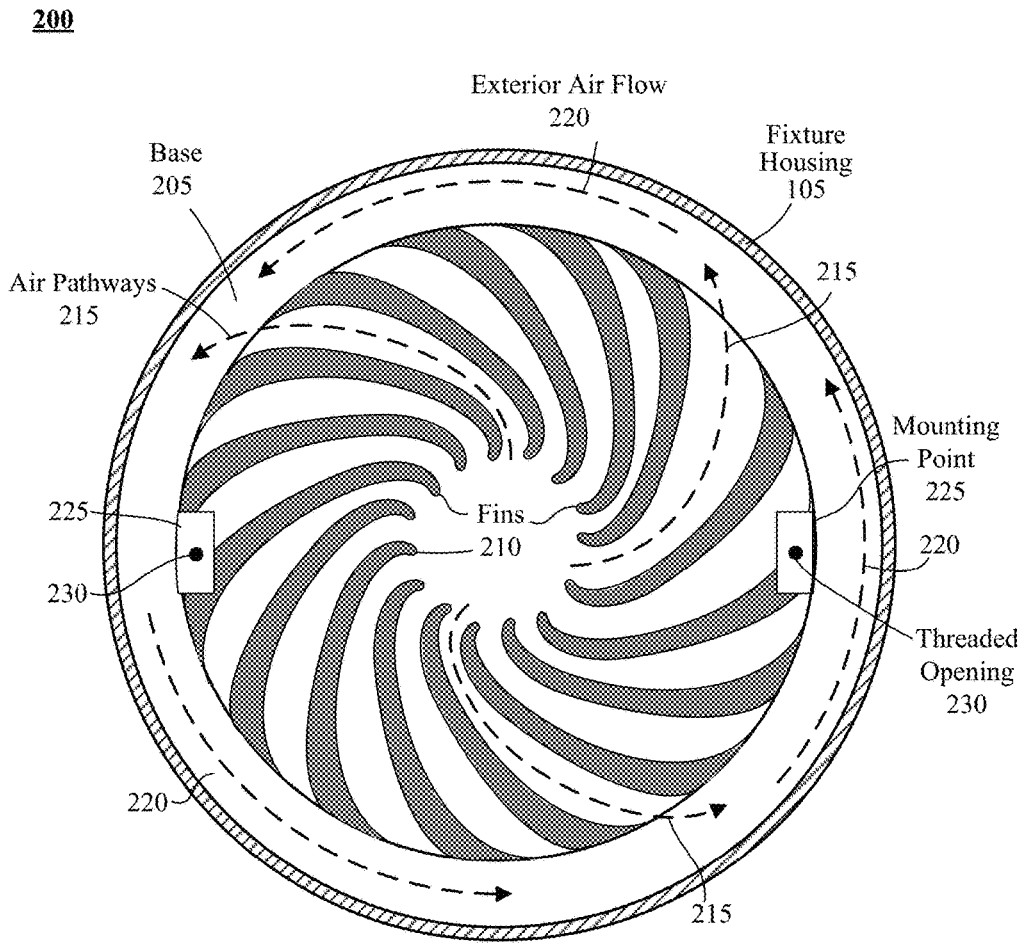
FIG. 2 is a schematic diagram of an example configuration for the passive cooling component of the improved heat sink in accordance with an embodiment of the inventive arrangements disclosed herein.

FIG. 2 is a schematic diagram of an example configuration for the passive cooling component 200 of the improved heat sink in accordance with embodiments of the inventive arrangements disclosed herein. This example configuration can be used within the LED light fixture 100 of FIG. 1.

A planar view of the passive cooling component 200 can be shown in FIG. 2. The passive cooling component 200 can be a unitary element having a substantially planar base 205 that fits within the fixture housing 105. As shown in FIG. 2, the base 205 of the passive cooling component 200 can be circular in shape; however, other base 205 shapes can be used, depending upon the overall design of the LED light fixture.

Multiple fins 210 can be arranged upon the planar surface of the base 205, extending upwards or perpendicular to the base 205. Each fin 210 can run radially from a center location of the base 205 to an edge in an arcing path. The fins 210 can form air pathways 215 between them that are also curved in shape. Thus, air blown by the active cooling component towards the base 205 (i.e., into the page) can travel along the arced air pathways 215, creating a counter-clockwise exterior air flow 220 around the exterior of the improved heat sink. The exterior air flow 220 can evenly distribute the heat around the exterior of the improved heat sink, minimizing the occurrence of hot spots that often occur in conventional linear-finned heat sinks.

The shape of the fins 210 and resultant air pathways 215 can create an air vortex within the LED light fixture. By organizing the air within the LED light fixture, contact of the heat-containing air with the outer surface of the LED light fixture can be increased. In this instance, the air can behave more like a fluid than a gas, increasing the thermal transfer with the outer surface of the LED light fixture.

The passive cooling component 200 can also include mounting points 225 that can be used to affix the passive cooling component 200 and/or improved heat sink within the LED light fixture 100. Each mounting point 225 can include a means by which mounting of the passive cooling component 200 can be achieved, such as a threaded opening 230 to receive a bolt or screw. The mounting point 225 can be located in areas of the base 205 that exclude fin structures 210 to allow proper mounting.

Figure 2A:
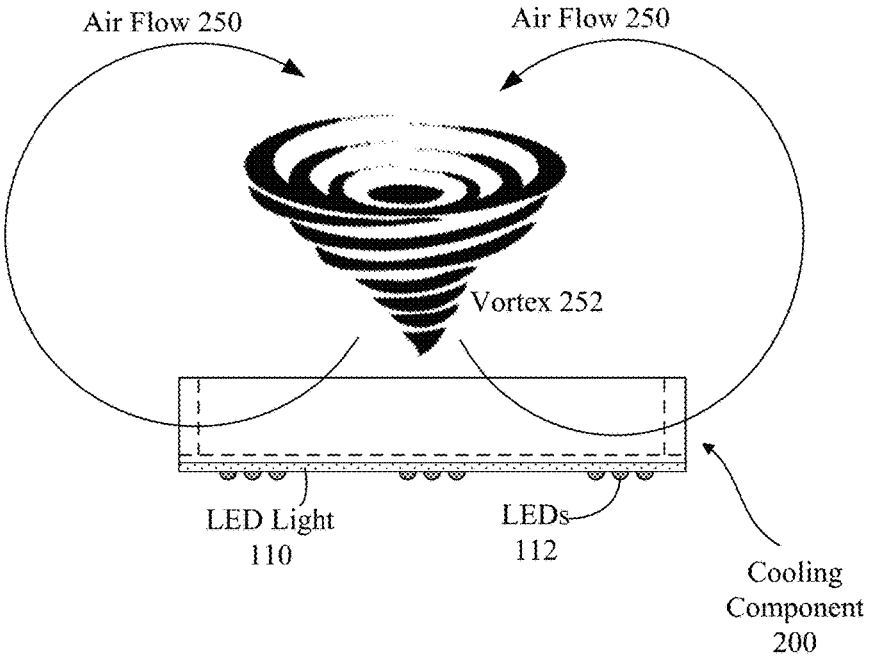
FIG. 2A is a diagram of an airflow through an improved heat sink in accordance with an embodiment of the inventive arrangements disclosure herein.

FIG. 2A is a diagram of an airflow through an improved heat sink in accordance with an embodiment of the inventive arrangements disclosure herein. FIG. 2A emphasizes that the cooling component 200 is designed to organize air flow 250 in a manner able to be referred to as a vortex design. While the cooling component 200 for the LED light fixture may utilize a fan to help direct the air flow 250, use of a fan is not to be construed as a limitation of this disclosure and any set of devices or technologies for circulating air may be utilized.

As shown, the vortex design of the cooling component 200 organizes the air flow 250 into a circular flow or vortex 252 to optimize transfer of heat from air molecules to a side of the fixture. This arrangement maximizes contact of air molecules to outer surfaces of the fixture 110, effectively biasing heat transfer to the outer surface, and away from the inner surfaces, thereby providing more efficient and optimal cooling for the LEDs 112. Effectively, the vortex design utilizes the air flow 250 to simulate a fluid, as opposed to a gas, which maximizes cooling though the organization of the air flow 250.

Figure 3:
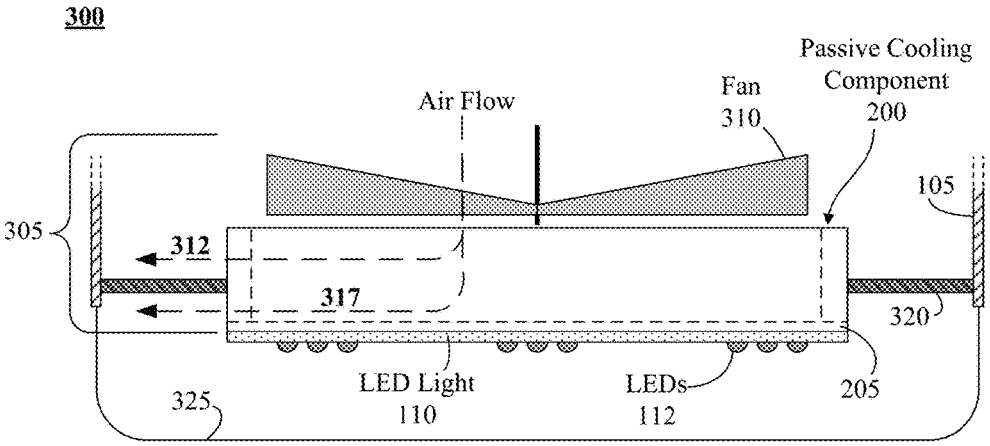
FIG. 3 is a side-view schematic diagram of an LED light fixture having the improved heat sink in accordance with an embodiment of the inventive arrangements disclosed herein.

FIG. 3 is a side-view schematic diagram 300 of an LED light fixture having the improved heat sink 305 in accordance with embodiments of the inventive arrangements disclosed herein. Schematic diagram 300 can represent a specific embodiment of the LED light fixture 100 of FIG. 1.

Figure 3A:
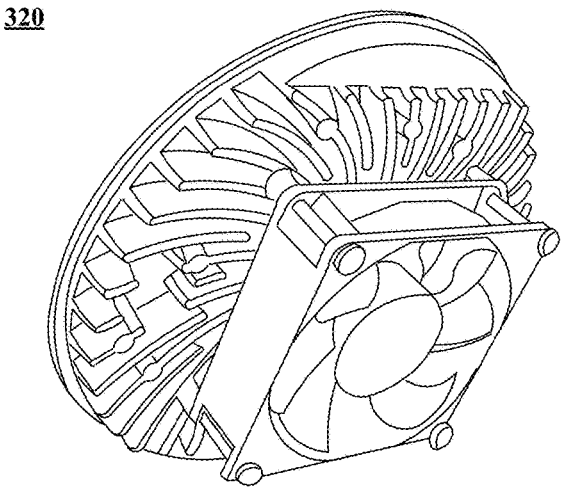
FIG. 3A is a diagram of an LED light fixture having the improved heat sink in accordance with an embodiment of the inventive arrangements disclosed herein.

As shown in schematic diagram 300, the improved heat sink 305 can be comprised of the passive cooling component 200 and an electric fan 310 as the active cooling component. The fan 310 can be of a type having high temperature endurance, low power consumption, long operating life, and good balance. For example, fan 310 can be a commercially available motor fan, such as the MAGLEV Motor Fan produced by SUNON, as shown in example embodiment 320 of FIG. 3A.

The passive cooling component 200 can be attached to a support element 320 of the LED light fixture such that the base 205 of the passive cooling component 200 is not flush with the support element 320. That is, the height of the passive cooling component 200 can be distributed above and below the support element 320. This configuration can significantly improve the heat dissipation provided by the improved heat sink 305.

When operating, the fan 310 can generate air flows in the direction of the arrows 312 and 317—towards the center of the base 205 of the passive cooling component 200, through the air pathways formed by the fins, and exiting the passive cooling component 200 at an outside edge. Since the air pathways exit the passive cooling component 200 both above and below the support element 320, two air flows 312 and 317 can be created.

Above the support element 320, air flow 312 can circulate air in the upper space of the LED light fixture. Below the support element 320, air flow 317 can circulate air around the LEDs 112 in the space between the fixture housing 105 and/or fixture enclosure element 325 and the LED light 110.

In some contemplated embodiments, a gap can exist between the edge of the support element 320 and the fixture housing 105 that can further increase the voluminous space in which the air flows 312 and 317 can circulate as well as provide insulation for thermal transference. That is, if the support element 320 is not in direct contact with the fixture housing 105, then environmental heat experienced by the fixture housing 105 cannot be directly transferred to the support element 320 and electronic components supporting operation of the LEDs 112.

Figure 4:
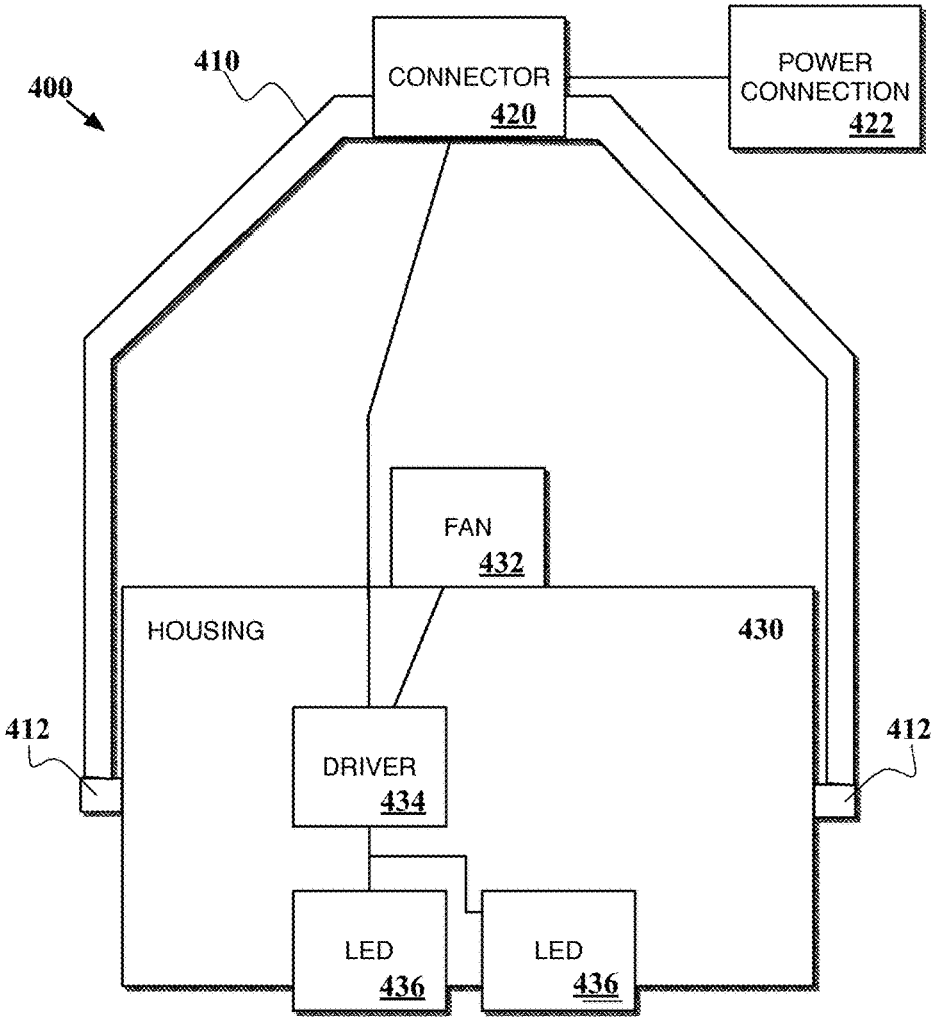
FIG. 4 depicts a high-level functional block diagram of bulb utilizing one or more heat sinks in accordance with an embodiment of the inventive arrangements disclosed herein.

The heat sink for LED light fixtures detailed herein can interoperate in accordance with numerous configurations, one of which is shown in FIG. 4. FIG. 4 depicts a high-level functional block diagram of bulb 400 utilizing one or more LED clusters, the bulb 400 comprising housing 430 and bracket 410. Housing 430 comprises LED units 436, e.g., LED circuit, etc., a driver circuit 434 for controlling power provided to LED units 436, and fan 432. LED units 436 and fan 432 are operatively and electrically coupled to driver 434 which is, in turn, electrically coupled to connector 420 and power connection 422.

LED units 436 generate light responsive to receipt of current from driver 434. In one embodiment, each LED unit 436 can represent a LED cluster. In another embodiment, each LED unit 436 represents a single element or LED of a LED cluster.

In at least some contemplated embodiments, driver circuit 434 is not a part of housing 430 and is instead connected between power connection 422 and connector 420.

In at least some embodiments, LED units 436 and fan 432 are electrically coupled to a single connection to driver 434. For example, in at least some embodiments, the electrical connection between driver 434 and LED units 436 and fan 432 comprises a single plug connection. The single plug connection may be plugged and unplugged by a user without requiring the use of tools.

In at least some embodiments, housing 430 may comprise a greater number of LED units 436. In at least some embodiments, housing 430 may comprise a greater number of fans 432.

Fan 432 rotates responsive to receipt of current from driver 434. Rotation of fan 432 causes air to be drawn in through vents in front face and expelled via vents in rear face. The flow of air through bulb 400 by rotation of fan 432 removes heat from the vicinity of LED units 436 thereby reducing the temperature of the LED unit. Maintaining LED unit 436 below a predetermined temperature threshold maintains the functionality of LED unit 436. In at least some embodiments, LED unit 436 is negatively affected by operation at a temperature exceeding the predetermined temperature threshold. In at least some embodiments, the number of vents is dependent on the amount of air flow needed through the interior of LED bulb 400 to maintain the temperature below the predetermined threshold. In at least some embodiments, fan 432 may be replaced by one or more cooling devices arranged to keep the temperature below the predetermined temperature threshold. For example, in some embodiments, fan 432 may be replaced by a movable membrane or a diaphragm or other similar powered cooling device.

In at least some embodiments, fan 432 is integrally formed as a part housing 430. In at least some other embodiments, fan 432 is directly connected to housing 430. In still further embodiments, fan 432 is physically connected and positioned exclusively within housing 430.

In at least some embodiments, fan 432 may be operated at one or more rotational speeds. In at least some embodiments, fan 432 may be operated in a manner in order to draw air into bulb 400 via the vents on rear face and expel air through vents on front face. By using fan 432 in LED bulb 400, thermal insulating material and/or thermal transfer material need not be used to remove heat from the LED bulb interior.

In at least some embodiments, fan 432 operates to draw air away from housing 430 and toward a heat sink adjacent LED bulb 400. For example, given LED bulb 400 installed in a light fixture, fan 432 pulls air away from housing 430 and LED units 436 and pushes air toward the light fixture, specifically, air is moved from LED bulb 400 toward the light fixture.

In at least some embodiments, existing light fixtures for using high output bulbs, e.g., high-intensity discharge (HID), metal halide, and other bulbs, are designed such that the light fixture operates as a heatsink to remove the heat generated by the HID bulb from the portion of the fixture surrounding the bulb and the bulb itself. In a retrofit scenario in which LED bulb 400 replaces an existing light bulb, e.g. a HID bulb, in a light fixture designed for the existing light bulb, fan 432 of LED bulb 400 operates to move air from the LED bulb toward the existing heat sink of the light fixture. Because LED bulb 400 typically generates less heat than the existing bulb, the operation of fan 432 in connection with the LED bulb increases the life of the LED bulb within the light fixture. LED bulb 400 including fan 432 takes advantage of the design of the existing light fixture heatsink functionality.

Driver 434 comprises one or more electronic components to convert alternating current (AC) received from connector 110 connected to a power connection 422, e.g., a mains power supply or receiving socket, to direct current (DC). Driver 434 transmits the converted current to LED units 436 and fan 432 in order to control operation of the LED unit and fan. In at least some embodiments, driver 434 is configured to provide additional functionality to bulb 400. For example, in at least some embodiments, driver 434 enables dimming of the light produced by bulb 400, e.g., in response to receipt of a different current and/or voltage from power connector 422.

In at least some embodiments, driver 434 is integrated as a part of housing 430. In at least some embodiments, driver 434 is configured to receiver a range of input voltage levels for driving components of housing 430, i.e., LED units 436 and fan 432. In at least some embodiments, driver 434 is configured to receive a single input voltage level.

Bracket 410 also comprises connection point 412 for removably and rotatably attaching the bracket and housing. In at least some embodiments, connection point 412 is a screw. In at least some further embodiments, connection point 412 is a bolt, a reverse threading portion for receipt into housing 430, a portion of a twist-lock or bayonet mechanism.

In operation, if one or more LED units 436 in a particular housing 430 degrades or fails to perform, the entire LED bulb 400 need not be replaced. In such a situation, only housing 430 needs replacing. Similarly, if driver 434 fails or degrades in performance, only housing 430 needs to be replaced. If, in accordance with alternate embodiments, driver circuit 434 is connected external of bulb 400, driver circuit 424 may be replaced separate from bulb 400. Because of the use of releasably coupled components, i.e., bracket 410 and housing 430, the replacement of one or the other of the components may be performed on location with minimal or no tools required by a user. That is, the user may remove LED bulb 400 from a socket, replace housing 430 with a new housing, and replace the LED bulb into the socket in one operation. Removal of LED bulb 400 to another location or transport of the LED bulb to a geographically remote destination for service is not needed. Alternatively, the user may remove driver circuit 434 from between power connection 422 and connector 420, in applicable embodiments, and replace the driver. Also, if the user desires to replace a particular driver 434 of a bulb 400, the user need only remove and replace the currently connected driver 434. For example, a user may desire to replace a non-dimmable driver with a driver which supports dimming. Also, a user may desire to replace a driver having a shorter lifespan with a driver having a longer lifespan. Alternatively, a user may desire to replace a housing having a particular array of LED units 436 with a different selection of LED units 436, e.g., different colors, intensity, luminance, lifespan, etc.; the user need only detach housing 430 from bracket 410 and reattach the new housing 430 to the bracket.

Figure 5:
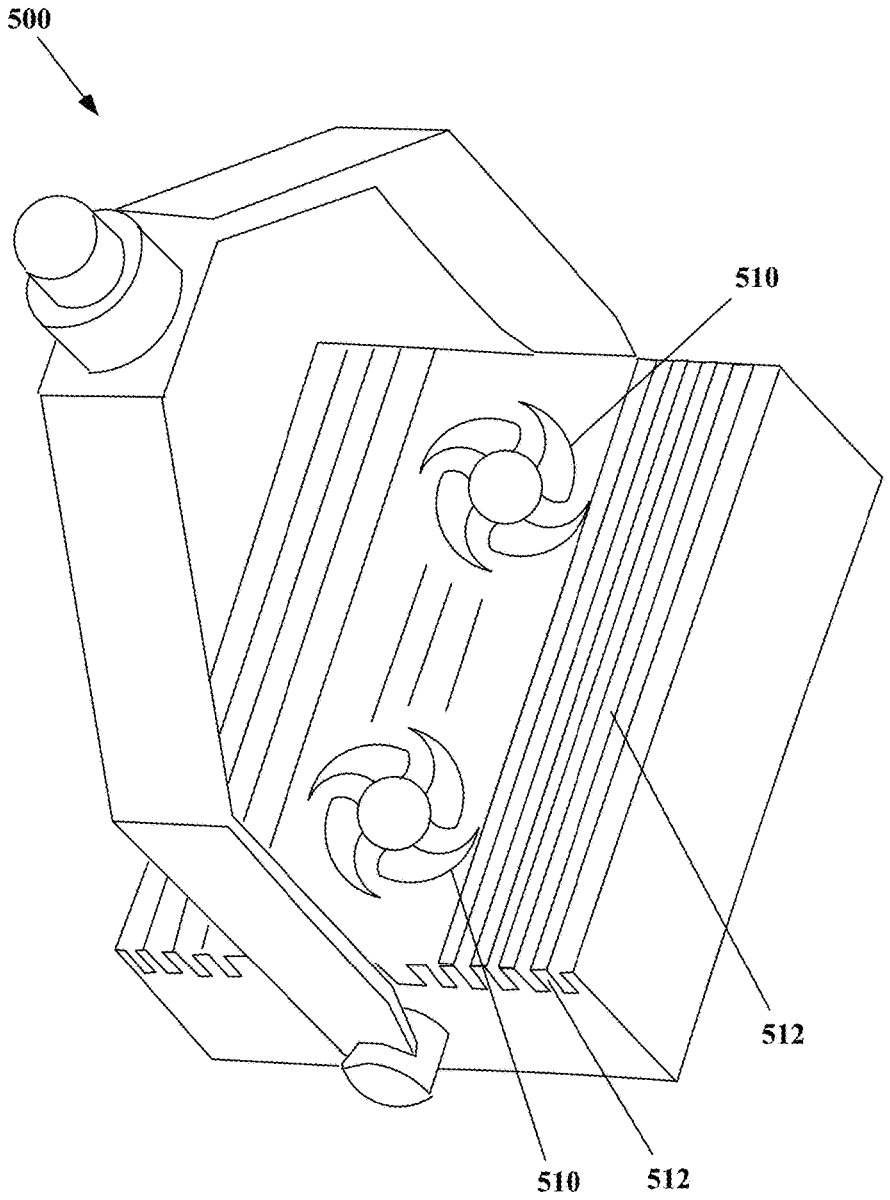
FIG. 5 depicts a heat sink for a LED structure in accordance with an embodiment of the inventive arrangements disclosed herein.

FIG. 5 depicts a heat sink for a LED structure in accordance with an embodiment of the inventive arrangements disclosed herein. Specifically, FIG. 5 depicts a rear-side perspective view of an embodiment of a LED bulb 500. The bulb has a housing 512 functioning as a heat sink. A set of one or more (two shown) cooling fans can be arranged on the rear side of the housing. These cooling fans 510 may be attached atop vanes for distributing heat across a wide surface area. The cooling fans 510 result in airflow in a direction away from the housing 512. It should be appreciated the FIG. 5 is a high-level one and the actual fans 510 utilized in conduction with the LED structure may more closely resemble the fan shown in FIGS. 2, 3, and/or 3A.

Figure 6:
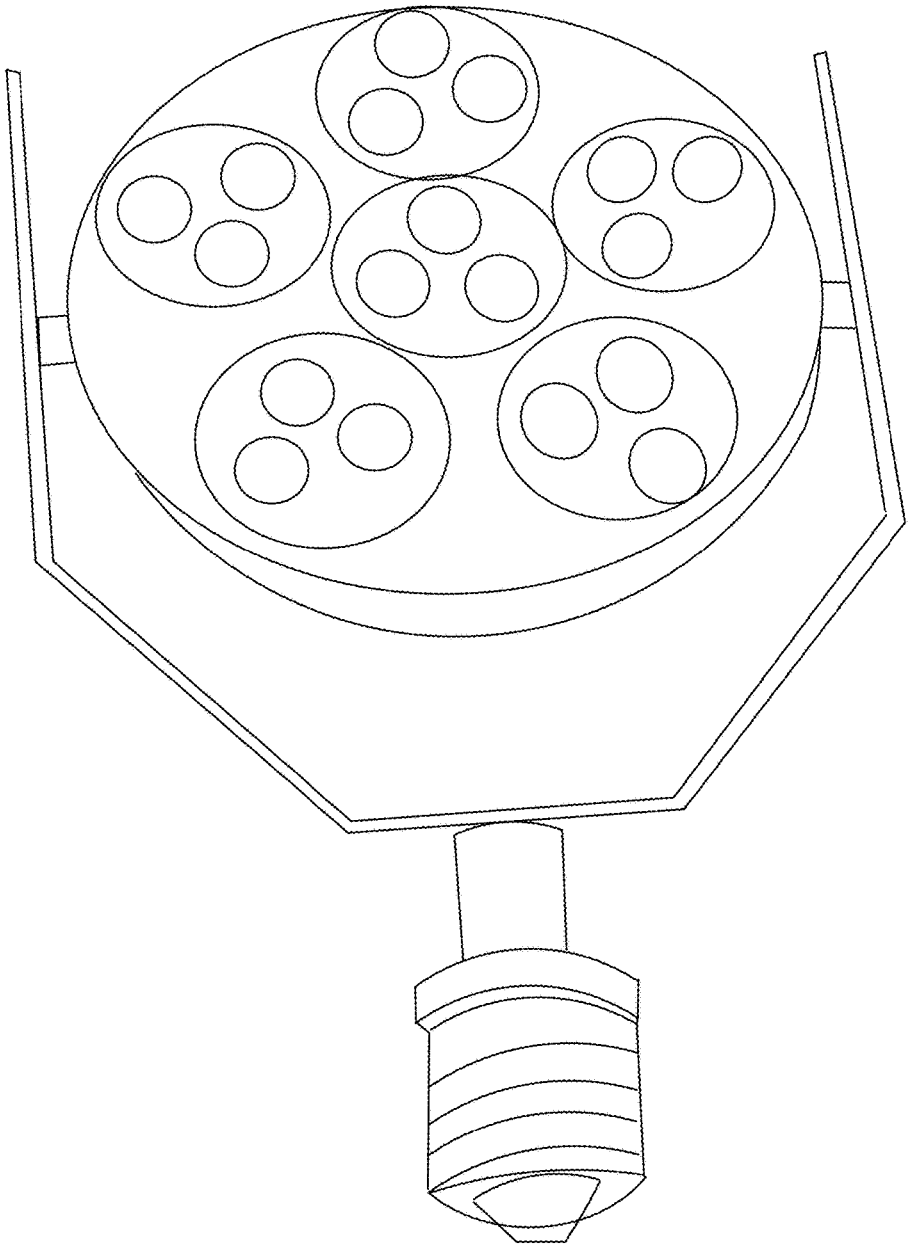
FIG. 6 is an illustration of a bulb in accordance with an embodiment of the inventive arrangements disclosed herein.

FIG. 6 is an illustration of an embodiment of bulb of one contemplated embodiment in a flat state. The bulb as illustrated comprises connection point affixed to housing. The illustrated connection point passes through openings in an arm of a bracket to enable the housing to be positioned along the length of the arm, in addition to enabling the rotation of the housing. FIG. 6 also depicts a bulb with a power connection attached to a connector.

Figure 7:
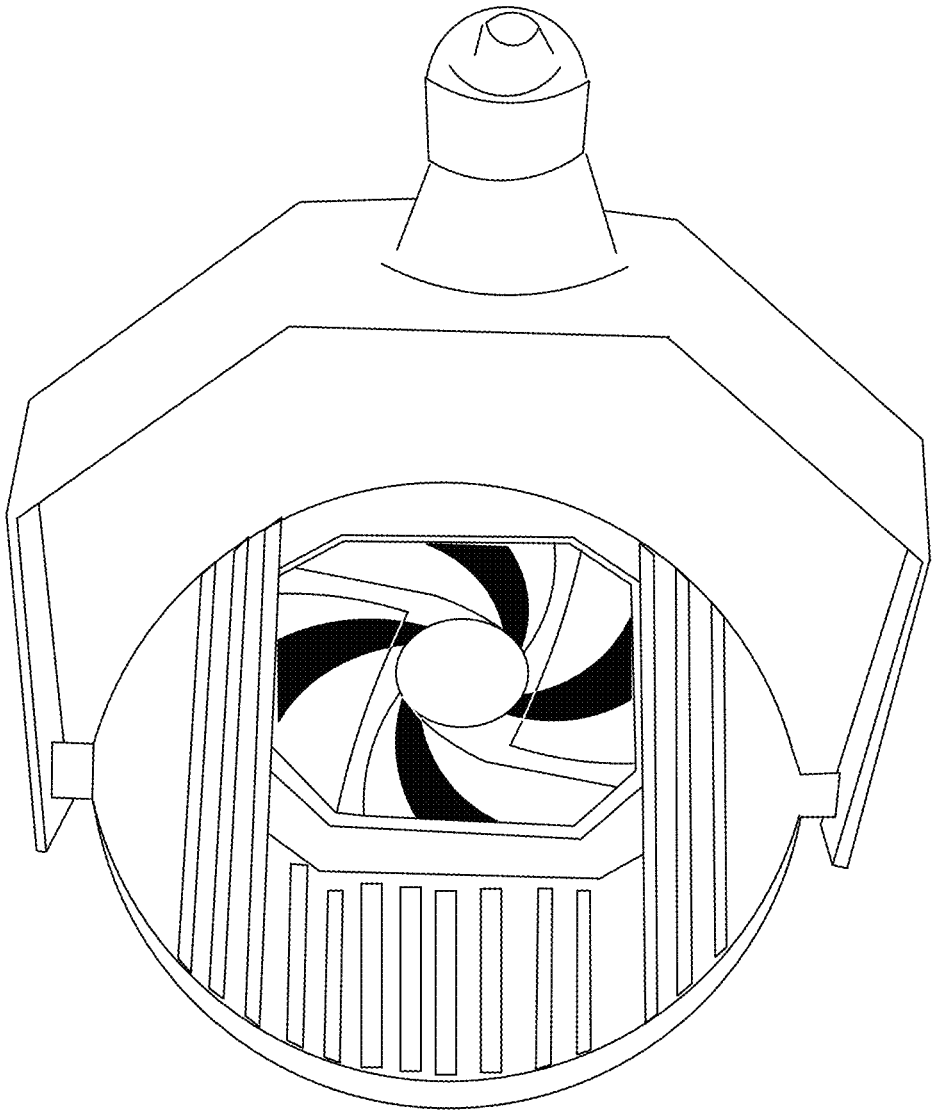
FIG. 7 is an illustration of a bulb having a housing in accordance with an embodiment of the inventive arrangements disclosed herein.

FIG. 7 is an illustration of one contemplated embodiment of a bulb having a housing at an angular displacement around the connection points, such that the housing is positioned at approximately a ninety degree angle with respect to the support arm. Appreciably, the fan is shown for context, and in one or more embodiments may be designed to more closely resemble the fan shown in FIGS. 2, 3, and/or 3A.

Figure 8:
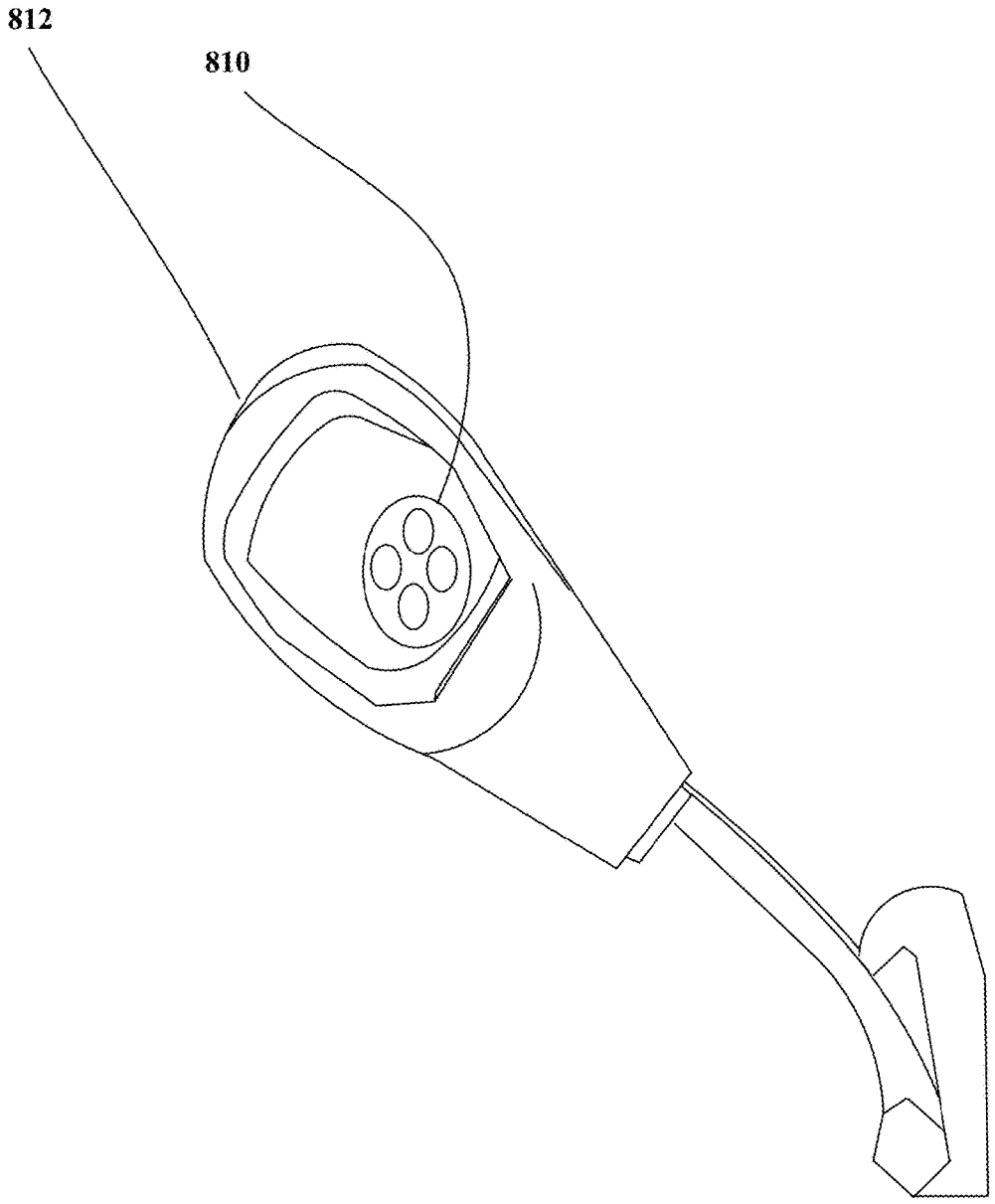
FIG. 8 depicts an image of an LED bulb installed in a light fixture in accordance with an embodiment of the inventive arrangements disclosed herein.

FIG. 8 depicts an image of an LED bulb 810 installed in a light fixture 812 in accordance with a contemplated embodiment of the disclosure. It should be appreciated, that in this context, the heat sink within the light fixture 812 may include one or more active elements, such as a fan. This fan may operate even when the LED bulb 810 is not emitting light. For example, to prevent excessive heat from being directed to circuitry during daytime hours, an active fan may selectively draw heat away from the circuitry, in one contemplated embodiment. In another embodiment, the fan may be selectively activated based on temperature, which can occur when the LED is emitting light and when the LED is not emitting light.

It should be understood that embodiments detailed herein are for illustrative purposes only and that other configurations are contemplated. For specifically, any arrangement of LED clusters consistent with the disclosure provided herein is to be considered within the scope of the disclosure.

The flowchart and block diagrams in the Figures illustrate the architecture, functionality, and operation of possible implementations of systems and/or methods according to various embodiments of the present invention. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. LED light fixture assembly comprising:

a light fixture, rated for a high intensity discharge (HID) bulb, having a female electrical socket;

a light emitting diode (LED) bulb for luminance at distances of one hundred feet or more, said LED bulb having a male screw connector for physical and electrical coupling to the female electrical socket;

an active cooling component configured to propel air in a desired direction; and a passive cooling component configured to organize the air propelled by the active cooling component to evenly dissipate heat within an enclosed space of the light fixture within which the LED bulb is coupled to the light fixture view screwing the mail screw socket into the female electrical socket, wherein the active cooling component is selectively active based on temperature when the LED bulb is not emitting light based to draw heat away from circuitry of the LED bulb.

2. The LED light fixture assembly of claim 1, wherein the light fixture is a streetlight for highway lighting.

3. The LED light fixture assembly of claim 1, wherein the passive cooling component is directly coupled to a substantially planar surface housing LED lighting elements of the LED bulb, wherein said passive cooling element further comprises:

a substantially planar base shaped to fit within the light fixture; and a plurality of fins extending upwards from the planar base, forming air pathways between the plurality of fins, wherein each fin is substantially arced in shape, originating from a central region of the planar base and ending at an outside edge of the planar base.

4. The LED light fixture assembly of claim 3, wherein the arced shape of the plurality of fins causes some of the propelled air to flow around the enclosed space of the light fixture, said enclosed space at least partially containing the LED bulb.

5. The LED light fixture assembly of claim 3, wherein the planar base further comprises:

at least two mounting points configured to secure the planar base to at least one of a circuit board having LEDs installed thereon, and the active cooling component.

6. The LED light fixture assembly of claim 1, wherein the active and passive cooling components are of a size and shape to fit into an existing fixture support structure designed for an incandescent light fixture.

7. The LED light fixture assembly of claim 1, wherein the active cooling component is powered by the male screw connector being screwed into the female electrical socket.

* * * * *